US006205761B1

(12) United States Patent
Wassenhoven et al.

(10) Patent No.: US 6,205,761 B1
(45) Date of Patent: Mar. 27, 2001

(54) SPINNING ROTOR WITH IDENTIFICATION MARK

(75) Inventors: Heinz-Georg Wassenhoven; Hans Grecksch, both of Mönchengladbach; Bert Schlömer, Heinsberg; Brigitte Riede, Mönchengladbach; Elisabeth Klaczynski, Wegberg, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/519,290

(22) Filed: Mar. 6, 2000

(30) Foreign Application Priority Data

Mar. 9, 1999 (DE) ..... 199 10 275

(51) Int. Cl.[7] ..... D01H 4/10
(52) U.S. Cl. ..... 57/414
(58) Field of Search ..... 57/263, 414, 264, 57/415, 417, 406

(56) References Cited

U.S. PATENT DOCUMENTS 4,150,530 * 4/1979 Derichs ..... 57/263
5,509,261 * 4/1996 Wassenhoven et al. ..... 57/263
6,009,700 1/2000 Wassenhoven et al. ..... 57/263

FOREIGN PATENT DOCUMENTS

2514734 * 10/1976 (DE) .
2634070 * 2/1978 (DE) .
4117175 * 11/1992 (DE) .
197 55 060 12/1997 (DE) .

* cited by examiner

*Primary Examiner*—Danny Worrell
(74) *Attorney, Agent, or Firm*—Kennedy Covington Lobdell & Hickman, LLP

(57) ABSTRACT

A spinning rotor adapted to be seated in a spinning box of an open-end spinning machine and having an identification mark (9), preferably embodied as alpha-numeric characters, formed at a location on the rotor cup (8) at which the information content of the identification mark (9) can be visually determined while within the spinning box after opening and stoppage of the rotor but without removal from the spinning box, thereby permitting a user-friendly, time-saving and dependable visual check of the spinning rotor type.

7 Claims, 1 Drawing Sheet

SPINNING ROTOR WITH IDENTIFICATION MARK

CROSS-REFERENCES TO RELATED APPLICATIONS

This application claims the benefit of German patent application DE19910275.9, filed Mar. 9, 1999, herein incorporated by reference.

FIELD OF THE INVENTION

The present invention relates to a spinning rotor having an identification mark thereon and seated in a spinning device of an open-end spinning machine. More particularly, the present invention relates to a spinning rotor having at least one optical identification mark in the form of an information carrier containing data specific to the type of spinning rotor and located on the of the exterior circumferential surface of the rotor cup in the area between the edge of the cup opening and the largest exterior diameter of the rotor.

BACKGROUND OF THE INVENTION

For maintenance and control purposes, the spinning rotors of an open-end spinning machine must be easy to access and monitor. If a spinning rotor of a spinning device, which customarily is embodied as a spinning station, is to be checked, removed or exchanged, a cover of the spinning device, e.g., a cover to a spinning housing in a typical open-end spinning station, is opened until into an upwardly pivoted position. This type of service check is performed, for example, if it is suspected that a spinning error or a malfunction has been caused by the spinning rotor, or if the yarn-piecing operation is repeated too often, or too may undesired cleaning cuts of the spun yarn are performed over a given period of time.

After the spinning box has been opened, the spinning rotor is accessible. However, prior to touching the rotor cup which, in the view of the operator, is located at the front of the opened housing, the operator must absolutely assure himself that the rotor has actually come to a stop. A clear visual indication that the rotor is at a standstill is provided by a marking applied to the rotor cup which does not move when the spinning rotor is stopped. The mere presence of such a marking on spinning rotors running at high revolutions is invisible to the eye. If no stopped marking is visible, the rotor cup may still be rotating, but it is also possible that the rotor is stopped but it has no markings. To make sure that a running spinning rotor is not touched, the operator typically takes more time to visually observe the rotor. This situation leads either to undesired waiting times or to safety risks.

If it has been found that such markings are not provided, an operator often applies these himself, for example in the form of a line applied by a felt-tip pen to the rotor cup. However, markings applied in this way must soon be redrawn, since they fade or can be rubbed off by the cleaning head of a traveling yarn piecing cart. Regardless, such markings in the form of a line are unsuitable as a basis for assuring a clear indication whether the correct types of spinning rotors have been employed in the spinning device. To perform such a check, it is therefore customarily necessary to remove the entire spinning rotor from the spinning device, so that the class of rotor can then be visually determined. If the spinning rotor is the correct type for the current spinning operation, the spinning rotor is reinstalled after checking. This method is awkward and time-consuming.

Not previously published German Patent Document DE 197 55 060, describes the basic type of spinning rotor discussed above. This document discloses a spinning rotor whose identification mark is in the form of either a bar code arranged in the area of the rotor cup or an electronic information carrier, for example in the form of a transponder. This marking is detected by means of a sensor arrangement, which prevents operation with unsuitable spinning rotors. During operation, these markings can also be used for measuring the number of revolutions by means of the sensor arrangement. However, such markings are still unsuitable for a visual check of the rotor type, since the operator cannot visually read bar codes or transponders to determine a sufficient indication as to the type or class of rotor. For spinning rotors with bar codes or transponders it is still necessary for the operator to remove the rotor to make such determination visually.

SUMMARY OF THE INVENTION

It is accordingly an object of the present invention to provide further improvements in the identification of spinning rotors.

In accordance with the present invention, this object is attained in a spinning rotor of the basic type comprising a rotor cup having an annular exterior circumferential surface between an annular edge which defines a rotor cup opening and an outer annular cup portion which defines a maximum diameter of the rotor cup and adapted to be mounted in a spinning device of an open-end spinning machine. According to the present invention, at least one identification mark is provided with an information carrier containing visually readable type-specific data for the spinning rotor and is formed at a location on the exterior circumferential surface of the rotor cup at which the data of the identification mark is visually readable by an operator when the spinning rotor is stopped during operation but without removal of the spinning rotor from the spinning device.

This design and arrangement of the identification mark, by means of which the information content of the identification mark is visually recognizable without removal from the spinning device following its opening avoids the unnecessary removal and reinstallation of the spinning rotor and thereby saves time and expense and aids in maintaining the productivity of the spinning device. Since removal of the rotor is no longer needed for checking the rotor type, the danger of injury to the operator because of possible contact with a still-running rotor cup is avoided, whereby the safety of the spinning device is increased.

An arrangement of the identification mark with a base portion of the identification mark oriented in the direction of the rotor cup opening and a head portion of the identification mark oriented in the direction of the greatest exterior diameter of the rotor cup, makes the rapid recognition of the identification mark and its information content easier and considerably reduces the danger of errors and mistakes.

In advantageous embodiments, two or more identification marks may be uniformly spaced over the circumferential surface of the rotor cup or at least one identification mark is positioned to be completely visible in any angular position of the spinning rotor provide for easy and rapid recognition of the mark. With these arrangements, the operator avoids the possible necessity of still being required to manually turn the spinning rotor in its bearing out of a standstill angular position in which the identification mark cannot be read or is insufficiently recognizable and into a position in which the identification mark is clearly visible.

An identification mark preferably created by etching or by means of a laser beam can be clearly recognized, is extraordinarily permanent and can be produced precisely and cost-effectively. In an advantageous manner, the identification mark preferably includes at least partially alphanumeric characters, preferably indicating a type identification of the spinning rotor. In this manner, the type-specific data for the rotor can be in the accustomed form of rotor type identifications which are known and familiar to the operator.

Because of its design, the identification mark can also be advantageously used along with sensor arrangements for the detection of the number of revolutions and the angular position of the rotor, e.g., by providing the mark with precise edges well suited as measuring points. As a result, additional markings for measuring the number of revolutions or for detecting the angular rotor position can be omitted altogether or at least partially.

Thus, a simple and rapid check of the type of spinning rotor used is possible with the spinning rotor in accordance with the invention, without removing the rotor from the spinning device, because the identification mark can be read in a glance from the front of an opened spinning device. Manipulation by the user is made easier because of the permanently applied identification mark. Moreover, the visual determination of whether the spinning rotor is still rotating after the spinning device has been opened becomes possible more simply and dependably. The spinning rotor in accordance with the invention is user-friendly and a time saver.

Further details, features and advantages of the present invention can be understood from the following specification of a preferred embodiment with reference to the accompanying drawings.

DETAILED DESCRIPTION OF A PREFERRED EMBODIMENT

Figure 1:
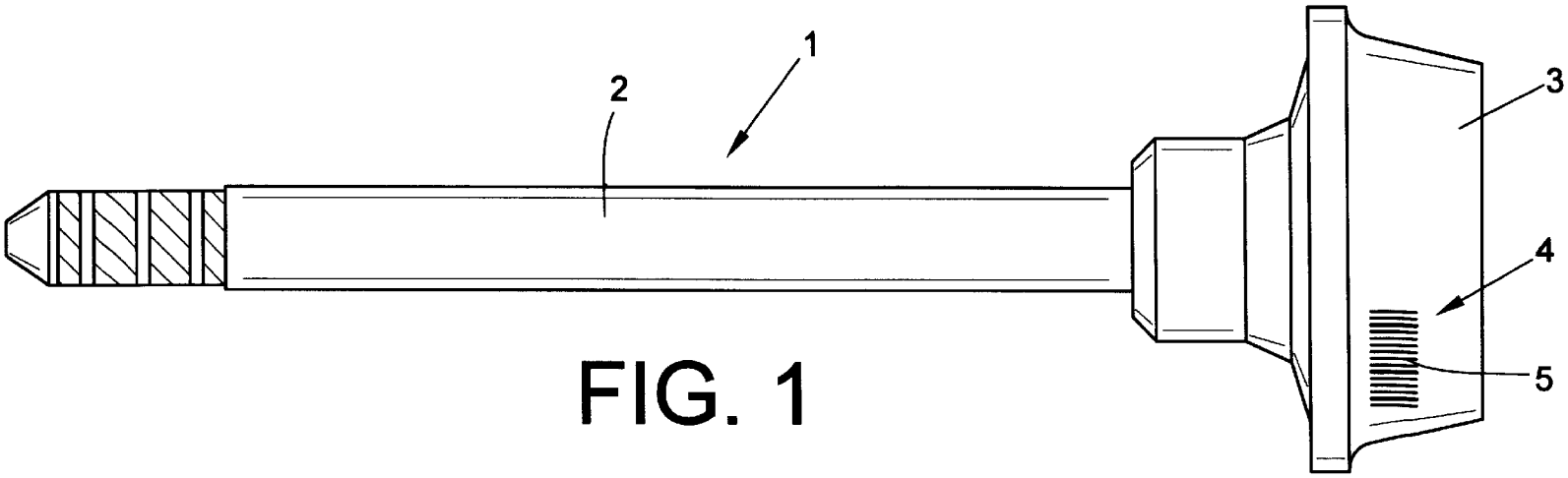
FIG. 1 is a side elevational view of a spinning rotor with a known form of visual marking thereon.

Referring now to the accompanying drawings and initially to FIG. 1, a spinning rotor 1 in accordance with the not previously published German Patent Document DE 197 55 060, having a rotor shaft 2 and a rotor cup 3. The rotor cup 3 has a visually readable identification marking 4, which is embodied as an information carrier in the form of a bar code 5 containing data specific to the spinning rotor, as is extensively described in German Patent Document DE 197 55 060. However, as already explained above, with such an identification marking 4, it is necessary to remove the spinning rotor 1 for a visual check of the spinning rotor type, since the operator cannot visually obtain sufficient information regarding the spinning rotor type from the identification marking 4.

Figure 2:
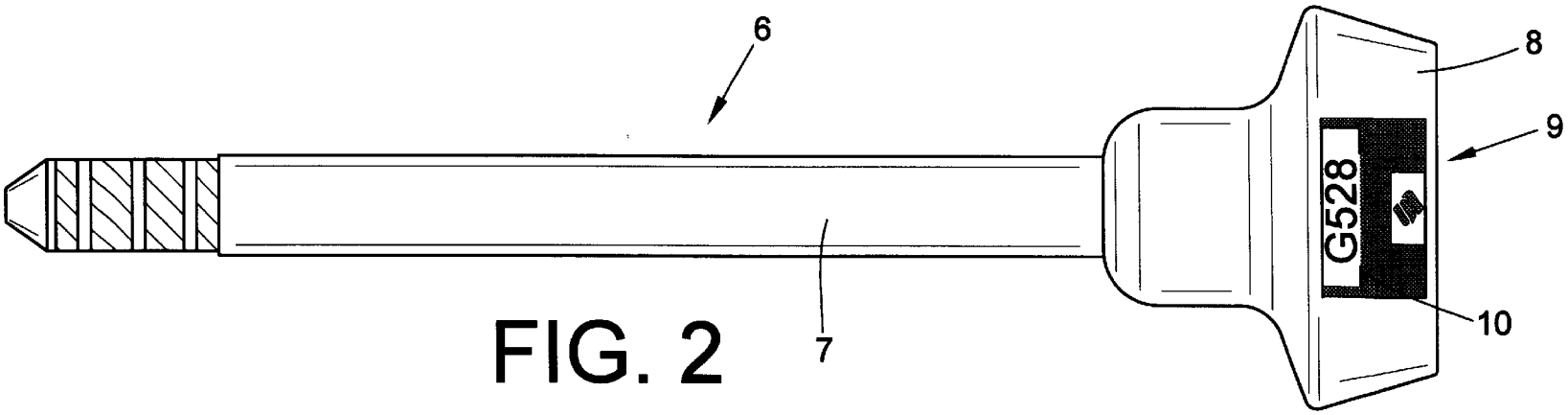
FIG. 2 is a side elevational view of a spinning rotor similar to that of FIG. 1 but depicting a spinning rotor with a visual marking in accordance with a preferred embodiment of the present invention.

FIG. 2 shows a spinning rotor 6, in accordance with the present invention, also having a rotor shaft 7 and a rotor cup 8. However, in contrast to the spinning rotor represented in FIG. 1, the rotor 6 has an identification mark 9 on the rotor cup 8 in place of a bar code 5, whose information content can be visually determined without removal of the spinning rotor from the spinning device, e.g., after the spinning device, e.g., a spinning box, has been opened and the spinning rotor 6 has stopped. Opening of the spinning box is performed, for example, if the spinning rotor 6 is to be checked. For this purpose, the housing cover of the spinning device is tilted forward around a pivot axis. The structural outlay of such housing covers and the arrangement of spinning rotors are known in principle, inter alia from the manual "AUTOCORO" of W. Schlafhorst AG & Co., and is therefore not shown nor explained in detail for reasons of simplicity. Following the opening of the housing cover, the rotor cup 8 is freely accessible for a visual check without further removal efforts and without unnecessary loss of time. In the represented arrangement on the rotor cup 8, the identification mark 9 is embodied in the form of a combination of a graphic symbol and alpha-numeric characters 10, which provides the information required by the operator easily and in an immediately recognizable manner.

Of course, as will be readily recognized and understood by those persons skilled in the art, a multitude of further embodiments of the identification mark 9 are possible within the scope of the invention.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A spinning rotor adapted to be mounted in a spinning device of an open-end spinning machine, the spinning rotor comprising a rotor cup having an annular exterior circumferential surface between an annular edge which defines a rotor cup opening and an outer annular cup portion which defines a maximum diameter of the rotor cup, and at least one identification mark including a visible information carrier containing human-readable indicia representing a type of the spinning rotor, the identification mark being formed at a location on the exterior circumferential surface of the rotor cup at which the indicia of the identification mark is visually readable by an operator when the spinning rotor is stopped during operation but without removal of the spinning rotor from the spinning device.

2. The spinning rotor in accordance with claim 1, characterized in that the at least one identification mark includes a base oriented in the direction of the cup opening and a head oriented in the direction of the maximum exterior diameter of the rotor cup.

3. The spinning rotor in accordance with claim 1, characterized further by at least two identification marks uniformly spaced about the exterior circumferential surface of the rotor cup.

4. The spinning rotor in accordance with claim 1, characterized in that the at least one identification mark is completely visible to an operator in any angular position of the spinning rotor.

5. The spinning rotor in accordance with claim 1, characterized in that the at least one identification mark is formed by etching or laser marking of the exterior circumferential surface.

6. The spinning rotor in accordance with claim 1, characterized in that the at least one identification mark comprises alpha-numeric characters.

7. The spinning rotor in accordance with claim 1, characterized in that the at least one identification mark is detectable during rotation of the spinning rotor for determining a number of revolutions and an angular disposition of the spinning rotor.

* * * * *